US010100678B1

(12) United States Patent
Chavez

(10) Patent No.: US 10,100,678 B1
(45) Date of Patent: Oct. 16, 2018

(54) RECIPROCATING PISTON ENGINE

(71) Applicant: Julio Chavez, Jupiter, FL (US)

(72) Inventor: Julio Chavez, Jupiter, FL (US)

( * ) Notice: Subject to any disclaimer, the term of this patent is extended or adjusted under 35 U.S.C. 154(b) by 327 days.

(21) Appl. No.: 14/991,235

(22) Filed: Jan. 8, 2016

Related U.S. Application Data

(63) Continuation-in-part of application No. 13/974,340, filed on Aug. 23, 2013, which is a continuation-in-part of application No. 12/640,441, filed on Dec. 17, 2009.

(51) Int. Cl.

| | |
|---|---|
| ***F01K 7/36*** | (2006.01) |
| ***F01K 3/08*** | (2006.01) |
| ***F01K 3/00*** | (2006.01) |

(52) U.S. Cl.
CPC ..... *F01K 7/36* (2013.01); *F01K 3/004* (2013.01); *F01K 3/08* (2013.01)

(58) Field of Classification Search
CPC .. F01B 7/08; F01B 11/004; F01B 1/08; F01K 3/04; F01K 7/36; F01K 3/004
See application file for complete search history.

(56) References Cited

U.S. PATENT DOCUMENTS

| | | | | | |
|---|---|---|---|---|---|
| 84,719 | A | * | 12/1868 | Thomson | F01B 9/02 91/186 |
| 289,250 | A | | 11/1883 | Goyne | |
| 371,636 | A | | 10/1887 | Snow | |
| 384,095 | A | | 6/1888 | Snow | |
| 426,421 | A | * | 4/1890 | Tidwell | F15B 11/20 91/178 |
| 511,016 | A | * | 12/1893 | Hansell | F01B 1/08 91/160 |
| 3,079,900 | A | | 3/1963 | Hunnicutt | |
| 6,006,517 | A | | 12/1999 | Kownacki | |
| 6,073,441 | A | | 6/2000 | Harju | |

* cited by examiner

*Primary Examiner* — F. Daniel Lopez
(74) *Attorney, Agent, or Firm* — Mark D. Bowen; Malin Haley DiMaggio & Bowen, P.A.

(57) ABSTRACT

A steam reciprocating piston engine that uses a pressurized working fluid to drive first and second pistons in reciprocating power strokes is disclosed. A piston is configured for reciprocating motion within the cylinder and traverses between bottom dead center and top dead center positions. An uppermost stop is reached wherein the working fluid is allowed to escape the cylinder through one or more exhaust ports whereby the fluid travels through a closed loop circuit ultimately directing pressurized fluid back into the cylinder inlet. Momentum causes a spring connected mass to continue upward maintaining the piston above the exhaust port so as to allow escape of the working fluid. Return of the piston and mass is caused by opposite movement of a second piston whereby another stroke is initiated. Power output may be transferred to any suitable system.

1 Claim, 9 Drawing Sheets

RECIPROCATING PISTON ENGINE

CROSS REFERENCE TO RELATED APPLICATIONS

This application is a continuation-in-part of U.S. patent application Ser. No. 13/974,340, filed on Aug. 23, 2013, which is a continuation-in-part of U.S. patent application Ser. No. 12/640,441, filed on Dec. 17, 2009.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to reciprocating piston engines, and more particularly to a rechargeable steam engine system.

2. Description of Related Art

An internal combustion engine is one in which combustion of the fuel takes place in a confined space, producing expanding gases that are used directly to provide mechanical power. Such engines are classified as reciprocating or rotary, spark ignition or compression ignition, and two-stroke or four-stroke. The most familiar combination is the reciprocating, spark-ignited, four-stroke gasoline engine, commonly found in automobiles.

The first person to experiment with an internal-combustion engine was the Dutch physicist Christian Huygens, about 1680. But no effective gasoline-powered engine was developed until 1859, when the French engineer J. J. Étienne Lenoir built a double-acting, spark-ignition engine that could be operated continuously. In 1862 Alphonse Beau de Rochas, a French scientist, patented but did not build a four-stroke engine; sixteen years later, when Nikolaus A. Otto built a successful four-stroke engine, it became known as the "Otto cycle." The first successful two-stroke engine was completed in the same year by Sir Dougald Clerk, in a form which (simplified somewhat by Joseph Day in 1891) remains in use today. In 1885 Gottlieb Daimler constructed what is generally recognized as the prototype of the modern gas engine: small and fast, with a vertical cylinder, it used gasoline injected through a carburetor. In 1889 Daimler introduced a four-stroke engine with mushroom-shaped valves and two cylinders arranged in a V, having a much higher power-to-weight ratio; with the exception of electric starting, which would not be introduced until 1924, most modem gasoline engines are descended from Daimler's engine.

The most common internal-combustion engine is the piston-type gasoline engine used in most automobiles. The confined space in which combustion occurs is called a cylinder. The cylinders are now usually arranged in one of four ways: a single row with the centerlines of the cylinders vertical (in-line engine); a double row with the centerlines of opposite cylinders converging in a V (V-engine); a double zigzag row somewhat similar to that of the V-engine but with alternate pairs of opposite cylinders converging in two V's (W-engine); or two horizontal, opposed rows (opposed, pancake, flat, or boxer engine). In each cylinder a piston slides up and down. One end of a connecting rod is attached to the bottom of the piston by a joint; the other end of the rod clamps around a bearing on one of the throws, or convolutions, of a crankshaft; the reciprocating (up-and-down) motions of the piston rotate the crankshaft, which is connected by suitable gearing to the drive wheels of the automobile. The number of crankshaft revolutions per minute is called the engine speed. The top of the cylinder is closed by a metal cover (called the head) bolted onto it. Into a threaded aperture in the head is screwed the spark plug, which provides ignition.

A significant disadvantage present with the use of internal combustion engines that burn hydrocarbon fuel is the resulting pollution. In order to meet U.S. government restrictions on exhaust emissions, automobile manufacturers have had to make various modifications in the operation of their engines, primarily to reduce the emission of nitrogen oxides and other toxic substances. The pollution generated by conventional internal combustion engines has spurred the development of engines capable of delivering power while significantly reducing, or entirely eliminating, polluting emissions.

U.S. Pat. No. 289,250, issued to Goyne discloses an operating valve for steam pumps wherein the piston is caused to flow forward and backward power strokes when the cylinder impacts piston L thereby moving slide valve C such that steam enters the opposite side of the piston.

U.S. Pat. No. 371,636, issued to Snow, discloses a Steam Bell Ringer wherein a suspended bell is swung by the thrust of a piston of a single acting engine wherein the steam-inlet is closed and the exhaust passage opened early in the stroke. Snow discloses use of a "three-winged puppet valve," referenced as "V" for controlling the admission of steam under the piston. The tail of valve "V" extends into the cylinder cavity so as to be struck by the piston in its decent thereby opening the valve.

U.S. Pat. No. 384,095, issued to Snow, discloses a Steam Bell Ringer wherein further improvements are disclosed. Steam is admitted under piston "B" to drive same upward to the upper end of its stroke until its momentum is spent whereafter "gravity" will cause it to descend.

U.S. Pat. No. 3,079,900, issued to Hunnicutt, discloses a fluid motor having an automatically operable servo valve that is directly responsive to pressure conditions and the position of the piston within the displacement chamber. A piston is resiliently biased toward one end of the cylinder by a compression spring. Compression spring functions to move the piston to its starting position where the face contacts an extending nose portion of poppet valve. Engagement of the poppet valve allows air to enter though conduit and throttle valve.

U.S. Pat. No. 6,006,517, issued to Kownacki et al., discloses a fluid engine wherein a valve rod is movably housed to open a valve opening and close exhaust apertures during the piston's power stroke.

U.S. Pat. No. 6,073,441, issued to Harju, discloses a pneumatic piston/cylinder apparatus which performs a single working stroke in one working direction, and is returned to its initial position without any external supply of compressed air by using a second compressed air channel to return the piston to its initial position.

Many of the references in the background art rely on steam as the working fluid. The use of steam as a working fluid relies on a steam generating apparatus, such as a boiler capable of producing high pressure steam. Use of a high pressure steam boiler, however, is considered undesirable due to complexity and the danger associated with high pressure steam. Furthermore, the high temperature associated with steam requires components capable of withstanding such temperatures further complicating the apparatus. A further complication recognized with fluid motors has been the development of a reliable reciprocating motor having simplified mechanics that provide reliable automatic cycling. The references in the art disclose overly complex valve and control structures that increase cost and degrade reliability. The references disclosed in the art simply fail to provide a reliable reciprocating piston motor. Accordingly, there exists a need for an improved reciprocating piston motor capable of use in powering a wide variety of devices.

BRIEF SUMMARY OF THE INVENTION

The present invention overcomes the limitations and disadvantages present in the art by providing an improved steam powered reciprocating piston engine capable of powering one or more pistons in reciprocating power strokes. A steam boiler has an output in fluid communications in fluid communication with the bottom portion of a generally vertically disposed cylinder via an inlet valve biased to a norriially closed position. A piston is configured for reciprocating motion within the cylinder and traverses between bottom dead center (BDC) and top dead center (TDC) positions. The piston is configured to engage the inlet valve when at the bottommost position thereby actuating the valve for a limited period of time to an open position so as to allow the introduction of the pressurized steam working fluid and initiating of the power stroke to drive the piston upward. The piston is driven upward by the working fluid until an uppermost stop is reached wherein the working fluid is allowed to escape the cylinder through one or more exhaust ports whereby the fluid travels through a closed loop circuit including a plurality of spaced check valves ultimately directing pressurized fluid back into the cylinder inlet. A mass is connected to the piston, in overhead relation, by a spring connection. When the piston reaches the uppermost stop, momentum causes the spring connected mass to continue upward thereby placing the spring in compression and maintaining the piston above the exhaust port so as to allow escape of the working fluid therethrough. Return of the mass downward, caused both by gravity and spring energy, along with power stroke of the linked second piston causes the piston and return the piston to its bottommost position whereby another stroke is initiated. Power output may be transferred to any suitable system.

As the piston approaches top dead center, the working fluid is allowed to escape into a fluid return circuit via a cylinder exhaust port which incorporates a check valve to ensure one-way travel. The fluid return circuit includes, in the direction of flow, at least one booster pump actuated by the upward movement of the main piston to increase the pressure of the fluid in the high pressure return circuit. The fluid return circuit terminates at a valve biased to a normally closed position.

Accordingly, it is an object of the present invention to provide an improved steam powered reciprocating piston engine incorporating a second pistono work in a reciprocating manner to complete a cycle.

In accordance with these and other objects, which will become apparent hereinafter, the instant invention will now be described with particular reference to the accompanying drawings.

DETAILED DESCRIPTION OF THE INVENTION

Figure 1:
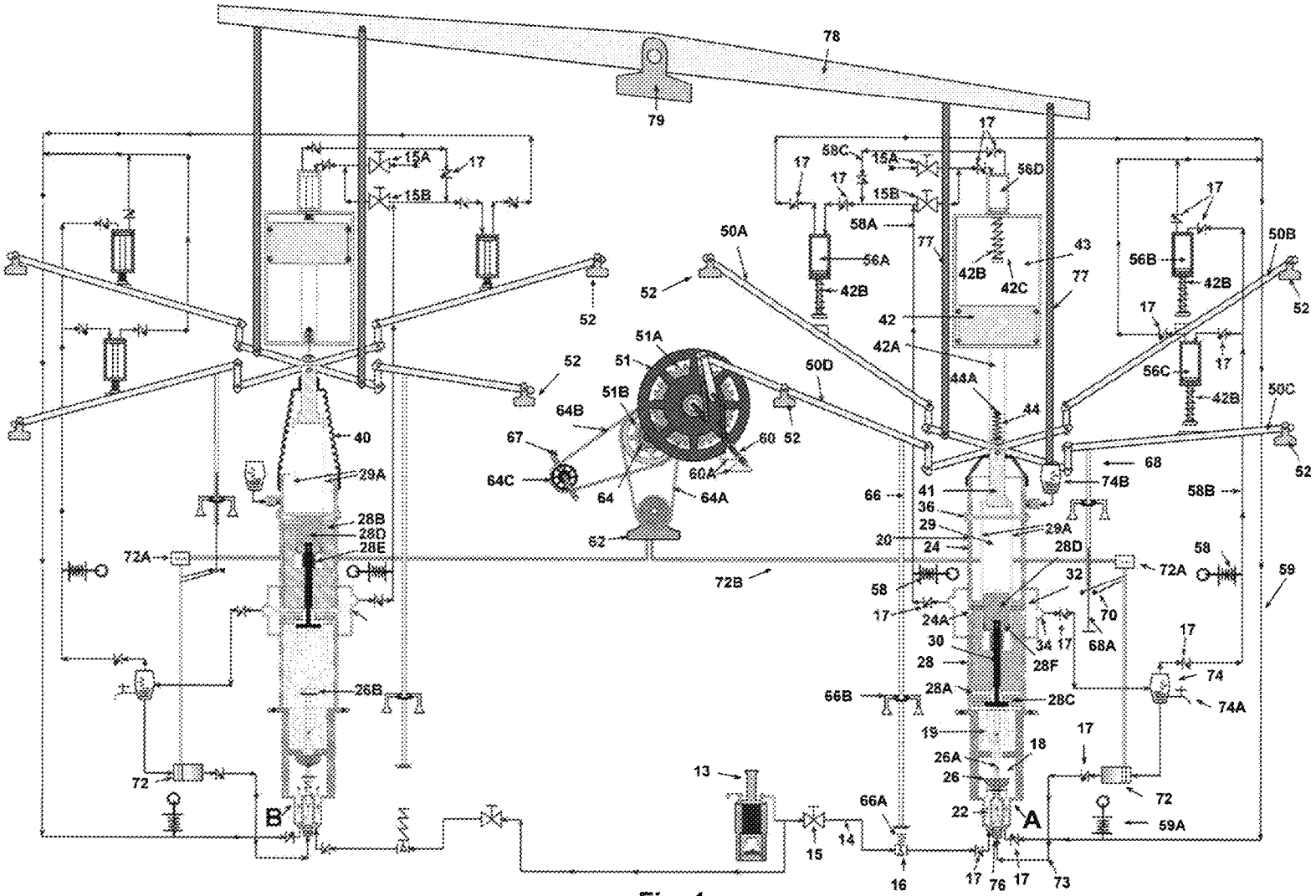
FIG. 1 is a sectional schematic illustration of a two-cylinder steam powered reciprocating piston engine system in accordance with the present invention with the first piston shown in the top dead center position, and the second piston shown in the bottom dead center position.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed.

herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Turning now to the drawings, FIGS. 1-9 illustrate a steam powered piston engine in accordance with the present invention, Any information or referenced number provided here in a singular manner applies to corresponding structure for each piston. FIGS. 1-4 provide a schematic illustration of a steam powered piston engine having first and second pistons, referenced as "A" and "B" respectively. A steam boiler 13 generates steam. and has an outlet in fluid communication with pressurized working fluid lines 14 (one for each piston). The working fluid lines 14 each include a manual shut off valve 15, a spring biased normally closed valve 16, and a one-way valve 17 (e.g. a check valve). Pressurized working fluid line 14 terminates in fluid communication with a valve 22 of steam piston engine, generally referenced as 20. Pressurized working fluid entering valve 22 travels into the main cylinder body 24 of engine 20 thereby providing a working fluid for cycling the steam engine.

Figure 2:
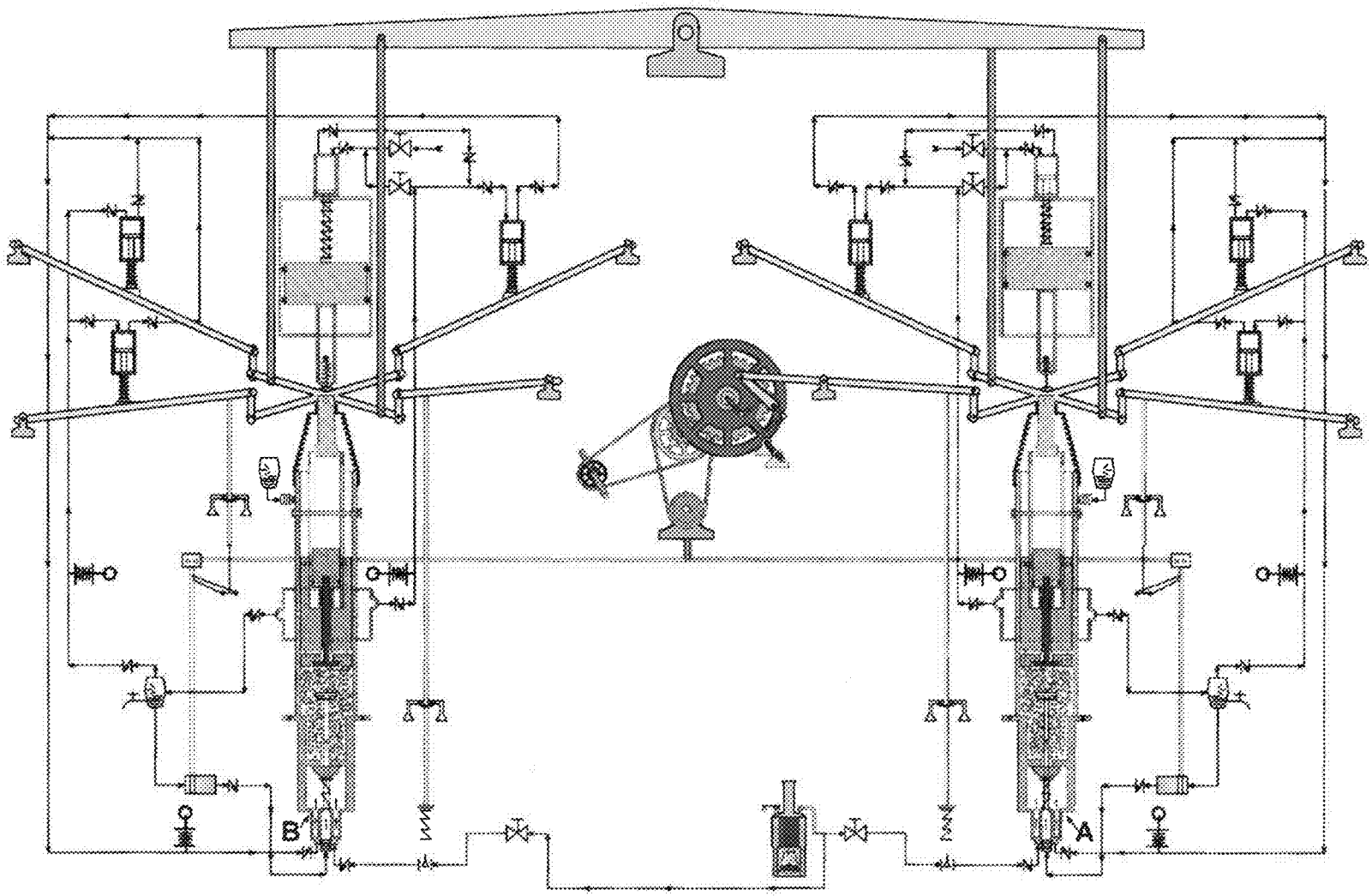
FIG. 2 is a sectional schematic illustration showing the first piston in mid-stroke returning to bottom dead center, and the second piston in mid-stroke during a power stroke.
Figure 3:
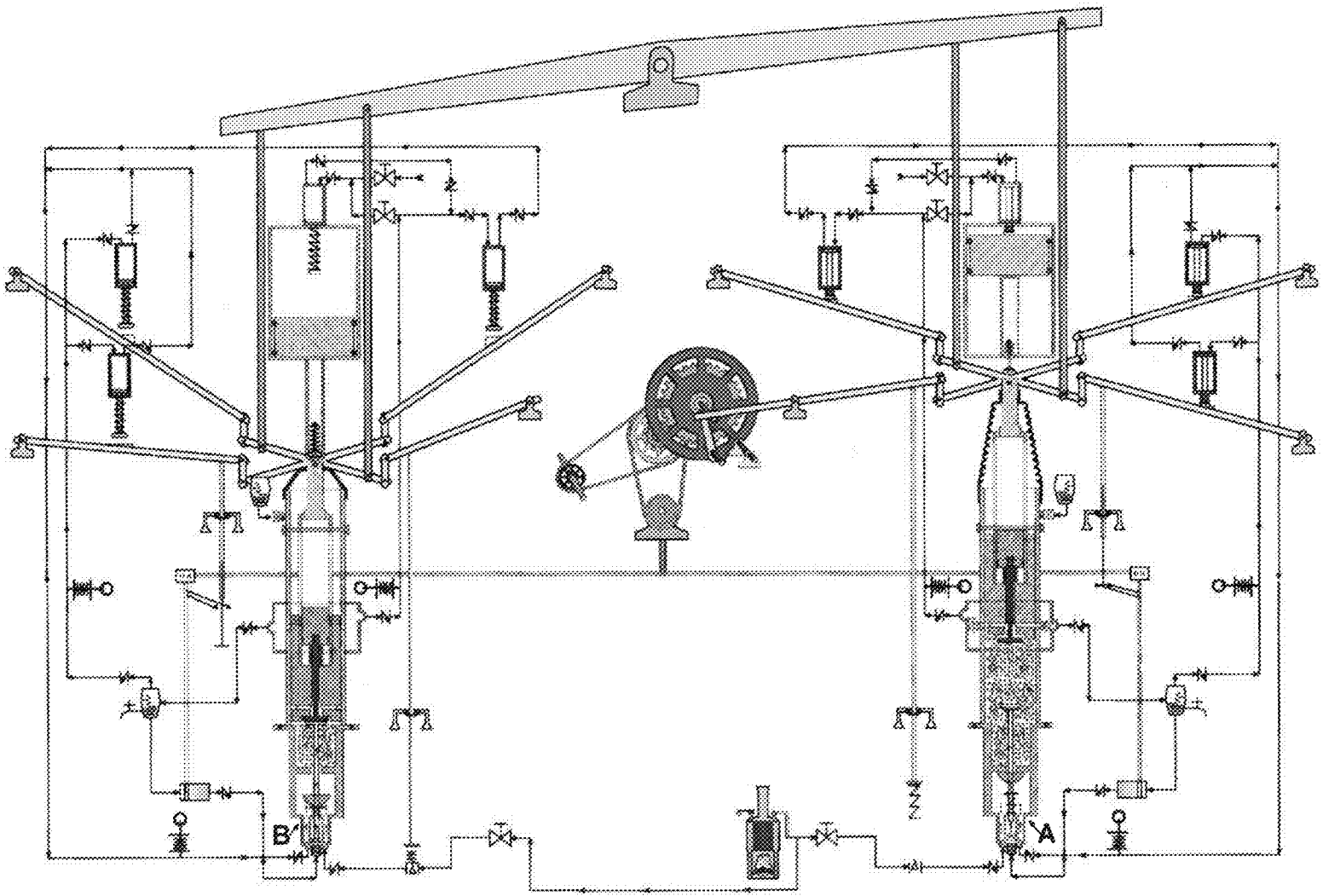
FIG. 3 is a sectional schematic illustration showing the first piston at the bottom dead center position, and the second piston in the top dead center position completing a power stroke.
Figure 4:
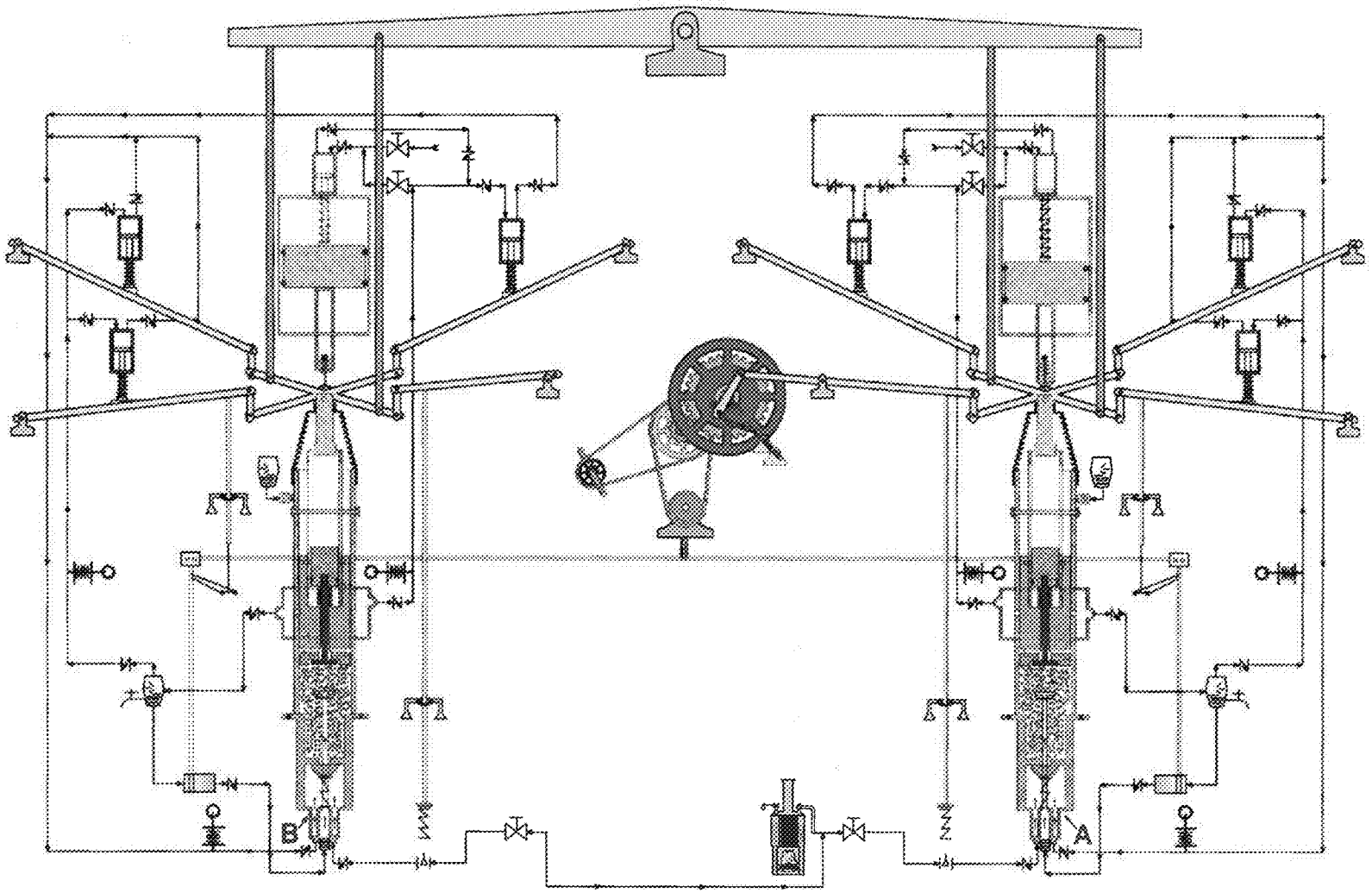
FIG. 4 is a sectional schematic illustration showing the first piston in mid-stroke during a power stroke, and the second piston in mid-stroke returning to bottom dead center.
Figure 5:
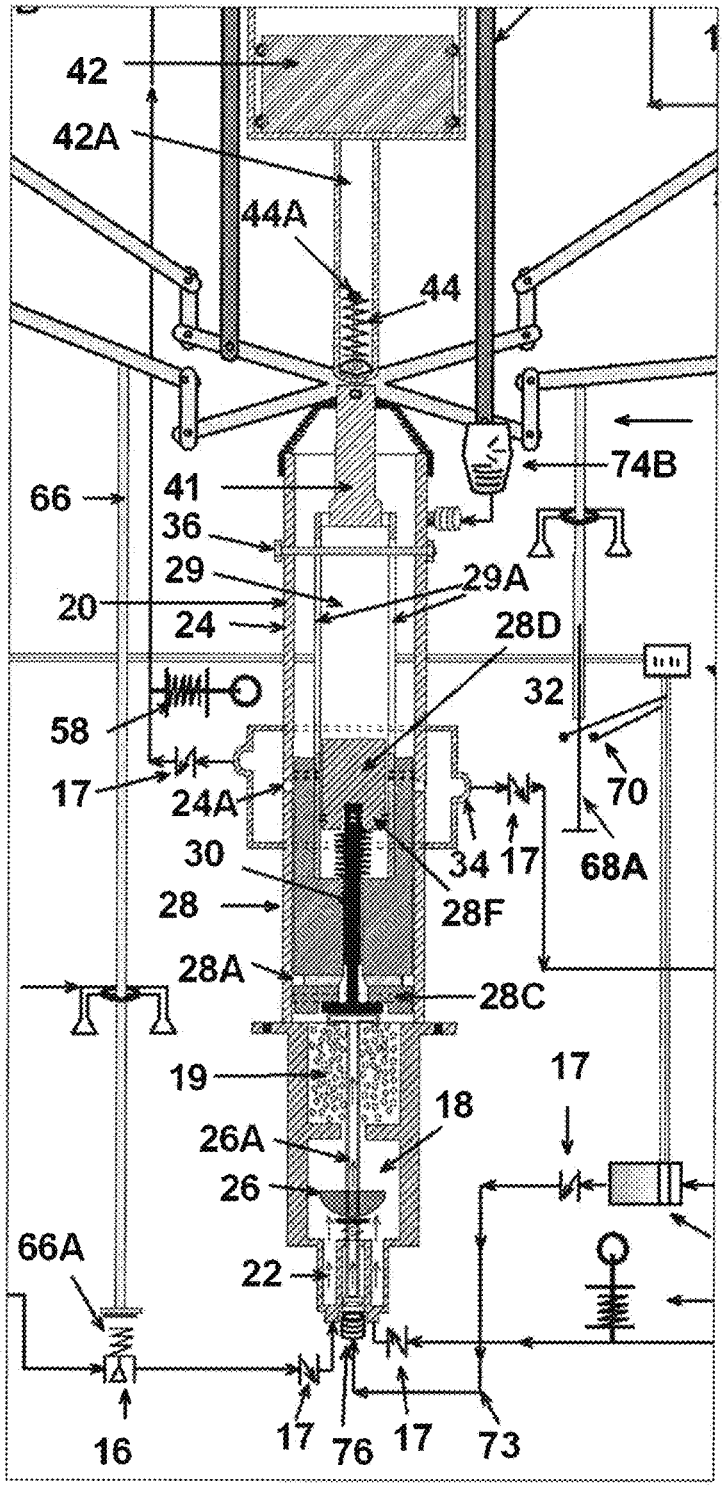
FIG. 5 is a partial detailed sectional schematic illustration of a piston in accordance with the present invention at the bottom dead center position.
Figure 6:
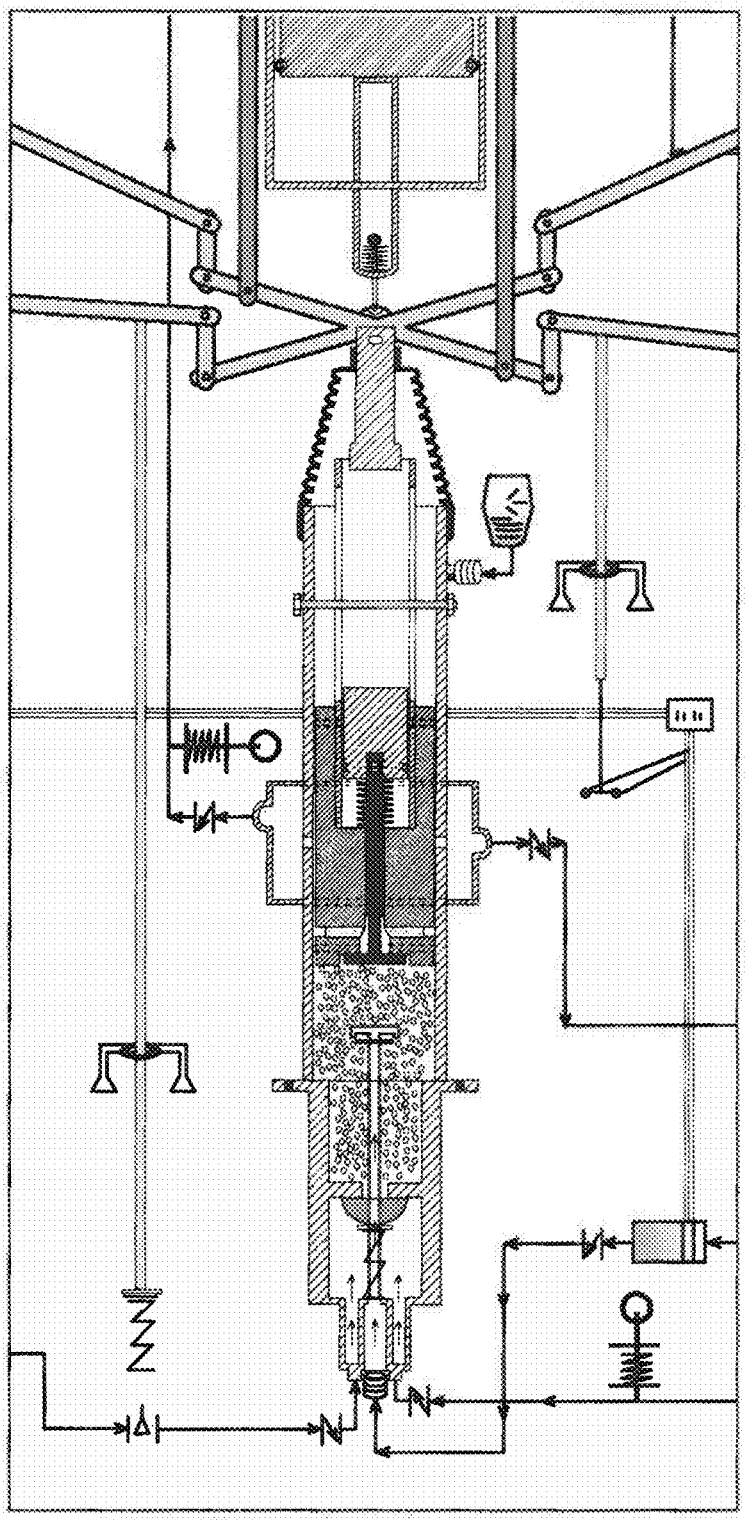
FIG. 6 is a detailed sectional schematic illustration thereof at a mid-stroke position during a power stroke.

The steam engine cycling is illustrated in FIGS. 1-4, wherein FIG. 1 is a sectional schematic illustration of a two-cylinder steam powered reciprocating piston engine system in accordance with the present invention with the first piston shown in the top dead center position, and the second piston shown in the bottom dead center position; FIG. 2 is a sectional schematic illustration showing the first piston in mid-stroke returning to bottom dead center, and the second piston in mid-stroke during a power stroke; FIG. 3 is a sectional schematic illustration showing the first piston at the bottom dead center position, and the second piston in the top dead center position completing a power stroke; and FIG. 4 is a sectional schematic illustration showing the first piston in mid-stroke during a power stroke, and the second piston in mid-stroke returning to bottom dead center.

Valve 22 includes two chambers, namely a first chamber 18 and a second chamber 19 in fluid communication with first chamber 18. First chamber 18 receives pressurized working fluid from line 14, and also receives recirculated working fluid from recirculating system line 59. Second chamber 19 receives water collected from line 58B which has an automatic relief valve 58 to prevent over pressure in the exhaust port. Valve 22 is spring-biased to a normally closed position when a reciprocating piston 28 is at topmost position or top dead center (hereinafter "TDC"). Pressurized fluid inlet valve 22 includes a valve stopper 26, configured to selectively shut off flow from valve inlets in fluid communication with lines 14 and 59. Valve stopper 26 is actuated by piston 28 to an open position when piston 28 reaches its bottom dead center position as illustrated in FIG. 1. Pressurized inlet valve 26 includes a stern 6A defining a through bore with a reinforced end 26B as shown in FIG. 1 to allow for introduction of liquid water in chamber 19 (as more fully discussed below) and water is expanded by the pressurized working fluid against piston 28 providing it more power and a better seal on piston rings 28C. Some water remains in the interior of cylinder 24 after piston 28 expels exhaust, but the water does not affect the downward movement of piston 28.

FIG. 1 illustrates the initiation of a power stroke on the piston 28, the piston system referenced as "A" disposed on the right-hand side of the page, wherein piston 28 moves upward by the introduction of pressurized working fluid. Piston 28 defines an exhaust channel 28A and a spring-biased normally-closed valve 30 controlling exhaust flow through channel 28A. Piston 28 further includes at least one upper ring and preferably two upper rings, referenced as 28B, to prevent the pressurized working fluid from escaping from the exhaust port hole 24A when piston 28 is at its bottommost position or bottom dead center (hereinafter "BDC"). Piston 28 also has at least one and preferably two rings, referenced as 28C, disposed at its bottom portion to seal the bottom portion of piston 28 and provide a good lift off. As piston 28 moves upward, it stops before rings 28C reach the exhaust port 24A thereby preventing damage to the rings 28C.

Figure 7:
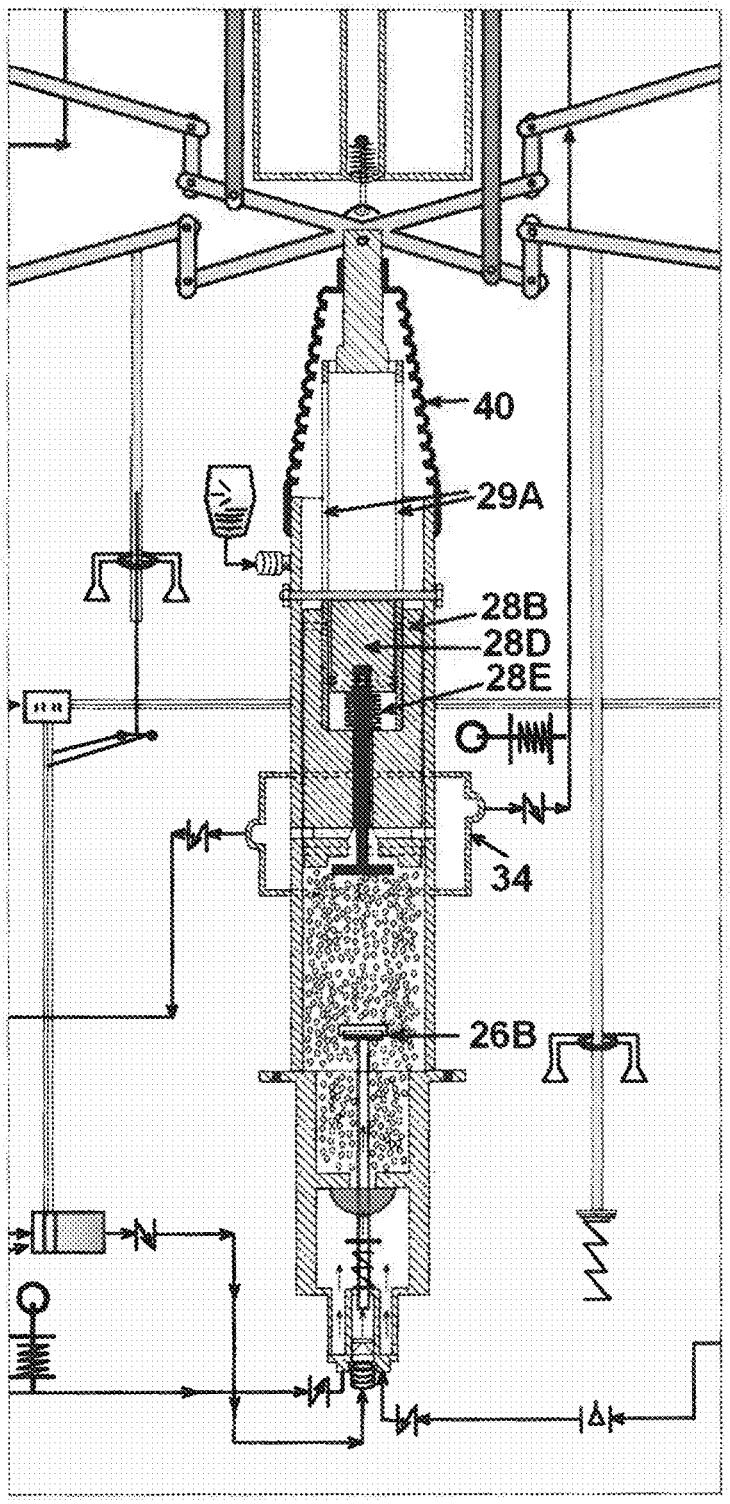
FIG. 7 is a detailed sectional schematic illustration thereof with the piston at top dead center.
Figure 8:
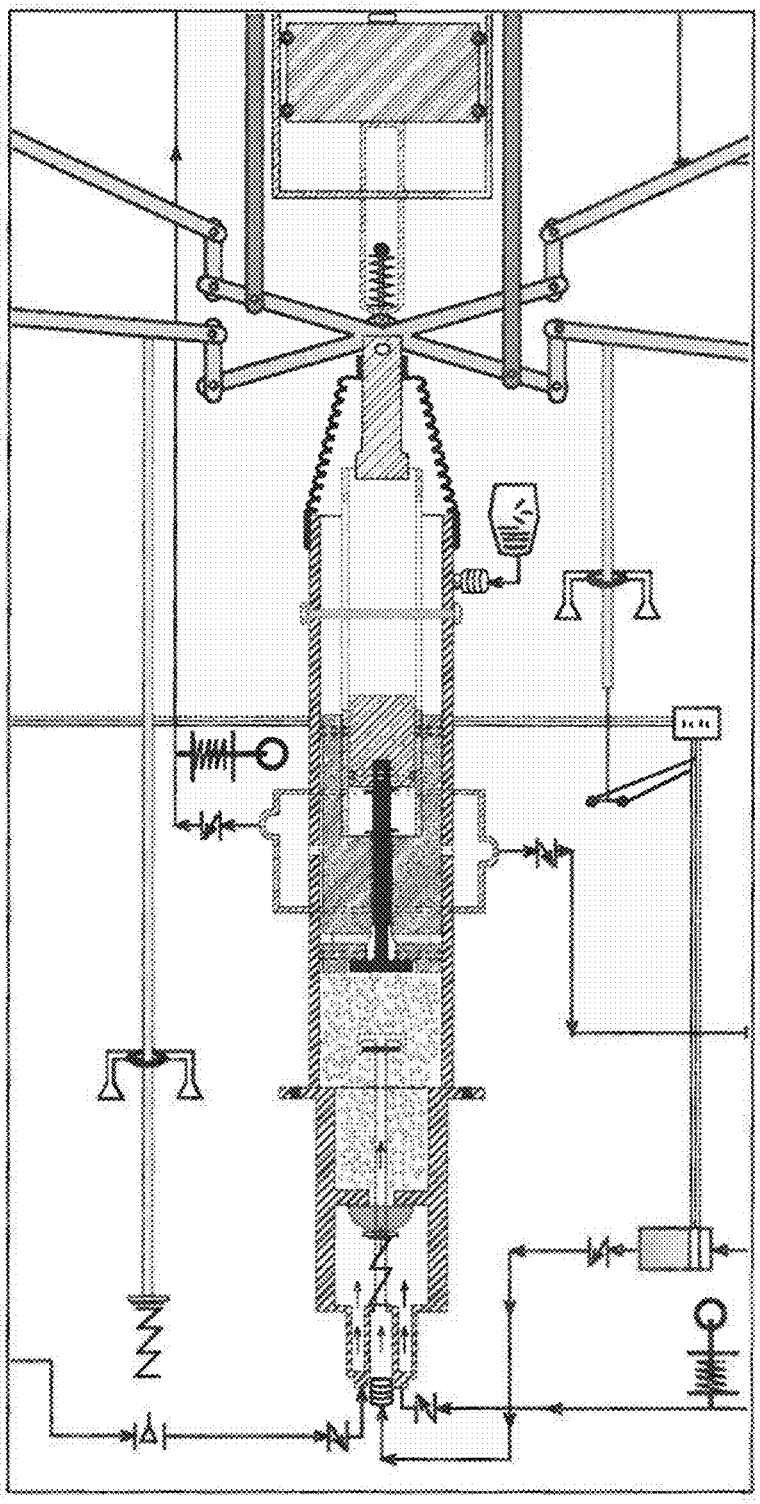
FIG. 8 is a detailed sectional schematic illustration thereof with the piston at a mid-stroke position during return to bottom dead center.

The pressurized fluid is exhausted through the center hole on piston 28 through channels 28A and through the cylinder wall opening 24A. Piston 28 has a small piston referenced as 28D at its top portion. Piston 28D has at least one and preferably two rings 28F that prevent pressurized fluid from escaping through valve 30 channel when piston 28 exhausts at its bottom portion. Further, a compressed spring 28E is disposed at an internal location which is a normally closed valve 30 controlling exhaust flow through channels 28A. Piston 28 has an upwardly projecting cylindrical extension 29 defining diametrically opposed slotted apertures 29A through which a stop 36 is disposed. As piston 28 moves upward relative to cylinder body 24 it ultimately reaches a top dead center TDC position wherein exhaust flow channel 28A comes into fluid communication with an exhaust port volume 32 defined by a surrounding collar 34 as illustrated in FIG. 7. Inserted piston 28D engages stop 36 which forces valve 30 downward to an open configuration thereby allowing pressurized fluid to escape cylinder 24 via channels 28A and cylinder outlet 24A.

Cylinder engine 20 defines an open top portion having an expandable accordion type bellow cap 40 that allow for reciprocating movement of a link arm 41 that axially projects through bellow cap 40 so as to allow for reciprocating movement therewith. Accordingly, bellow cap 40 moves from a retracted configuration as shown in FIG. 1 (piston "A") to an expanded configuration as shown in FIG. 3 (piston "A"). Engine 20 also has an oil container 74B that is operated by gravity to lubricate top portion of piston 28. Cylindrical extension 29, whose interior bottom portion receives piston 28D, is in threaded engagement with the top portion of piston 28. Link arm 41 is connected on one end thereof to cylindrical extension 29, and on the other end thereof to a mass 42 via a tubular extension 42A, and a spring 44 with an internal location connector 44A whereby mass 42 moves freely about one inch and a half, compressing and decompressing spring 44, and pulling piston 28 upward developing a second force to increase the speed in the flywheel 51 connected to lever arm 50D. Mass 42 preferably weighs about ten pounds, and both pistons (or in an alternate embodiment four pistons) each transfer their power to flywheel 51.

Link arm 41 is connected to a plurality of lever arms, referenced as 50A, 50B, 50C, and 50D, each of which is connected to a pivot connection 52 for pivotal movement driven by reciprocating movement of piston 28. More particularly, reciprocating movement of piston 28 assisted by momentum of mass 42 cause pivotal reciprocating movement of lever arms 50A, 50B, 50C, and 50D. When lever arms 50A, 50B, and 50C move upward they impact booster pumps referenced as 56A, 56B, and 56C placing them in a compressed position as seen in FIG. 3 with the piston system referenced as "A". Each of the booster pumps return to their original position by spring forces applied by springs 42B. Mass 42 is launched by piston 28 with such power so as to impact and compress booster pump 56D. In addition, the upward momentum of mass 42 pulls up link arm 41 and piston 28. Booster pump 56D intakes air from the exterior via manually open valve 15A and compresses it into conduit line 58A through conduit line 58C before piston 28 discharges from piston cylinder 24A such that the air is compressed in conduit line 59 by the upward movement of pump 56A thereby increasing the pressure. When enough air has been compressed manual valve 15A is closed and manual valve 15B is opened to allow exhaust fluid to circulate through booster pump 56D to keep its reciprocating movement. Track 43 functions as a guide to guide mass 42 into impact with booster pump 56D.

Each booster pump 56A, 56B, 56C and 56D has an inlet in fluid communication with cylinder outlet 24A, via collar 34, and exhaust conduits 58A and 58B, which further include at least one check valve 17 that functions to prevent reverse flow. Exhaust conduit 58A routes exhaust from cylinder 24 to booster pumps 56A and 56D, whereas exhaust from conduit 58B routes exhaust from cylinder 24 to booster pumps 56B and 56C. Exhaust conduit 58A and 58B are evacuated by booster pumps 56A, 56B, 56C, and 56D, drawing the pressurized working fluid contained therein each time piston 28 moves to BDC position, and thus leaving exhaust port volume 32 empty (i.e. un-pressurized) and ready to receive the exhaust from the next cycle.

Exhaust conduits 58A and 58B each have an automatic pressure relief valve, referenced as 58. Valves 58 prevent over pressure in those sections in the event of one or more booster pumps fail. In addition, pressure relief valves 58 further function to allow for the manual discharge of pressure when starting the system. Return conduit 59 includes a pressure relief valve 59A and is a continuation of conduit 58A and 58B, it starts in fluid communication with the booster pump outlets 56A, 56B, and 56C to allow the exhaust working fluid to be compressed and recirculated by the booster pumps 56A, 56B, and 56C and returns the working fluid to valve 22 and cylinder 24.

Valve 16 stops or reduces the high pressure flow on the working fluid supply line 14 coming from boiler 13 to allow booster pumps 56A, 56B, and 56C introduce working fluid into valve 22 and cylinder 24. In addition, valve 22 receives high pressure working fluid from line 14 when piston 28 is at the BDC position repeating the cycle and getting the same power stroke each time piston 28 is launched upward. Any amount of working fluid that does not get into the cylinder remains in chamber 18, and is subsequently injected by either action of booster pumps 56A, 56B, and 56C, or by high pressure line 14. Normally closed valve 16 is actuated by a push rod 66 having a distal end there of 66A configured for actuating engagement with valve 16 when piston 28 returns to the (BDC) position as show in FIG. 1 with piston system "A".

Lever arm 50D is mechanically connected to a flywheel 51 through a crankshaft 60. The reciprocating movement of pistons 28, and momentum of mass 42 connected to link aim 41 causes pivotal movement of lever arms 50A, 50B, 50C, and 50D. Pivotal movement of lever arm 50D causes rotation of flywheel 51 and power transmission system 51A. Power transmission system 51A turns a double action pulley 64 through a smaller wheel gear 51B. Double action pulley drives two belts, namely belts 64A and 64B. Belt 64A drives a generator 62 to provide power for water pumps 72 and power outlets 72A through an electrically conducting wire 72B. Belt 64B drives a pulley 64C with about and axel. 67 to transfer power output to any other suitable devised apparatus. Lever arm 50C is mechanically connected to a push rod 68 having a distal end thereof 68A configured to actuate an electrical switch 70 when piston 28 reaches its midway position to energize the water pump 72. More particularly, water s injected into chamber 19, and when valve 26 is opened pressurized working fluid expands the water against piston 28 providing functioning to improve the seal in between the piston rings and cylinder wall so as to maximize compression and power in the piston stroke. Water recirculates providing lubrication to the pistons. Water accumulator 74 includes a drain valve 74A and is disposed in exhaust conduit 58B and functions to accumulate water entrained within the exhaust fluid. Pump 72 is in communication with the water reservoir within accumulator 74 and has an outlet in communication with a water injector 76 via water line 73 so as to inject water in chamber 19 through a stem 26A which defines a through bore to allow for introduction of water. Accordingly, water is injected into chamber 19 by injector 76 and is dispersed by the pressurized working fluid against piston 28 through cylinder 24 exiting exhaust port 24A whereby the water is routed through exhaust line 58B and through accumulator 74 where the entrained water is separated and collected therein for recirculating by pump 72.

Link arm 41 has two push rods 77 for connecting to a lever arm 78 configured for pivotal movement about a pivot 79 to allow for reciprocating movement between pistons A and B. Piston A turns flywheel 51 via lever arm 50D turning this system in a powerful machine capable of recycling a significant portion of its working fluid while reducing fuel consumption as well as preventing contamination of the working fluid.

The system disclosed herein is preferably initially started by manual application of force in addition to pressurized working fluid. More particularly, by first applying pressure in line 14 whereafter both pistons move to the center position, then manually urging the first piston ("A") upward whereby the second piston ("B") is urged downward by the mechanical linkages such that the second piston actuates valve 22 to start the engine.

Figure 9:
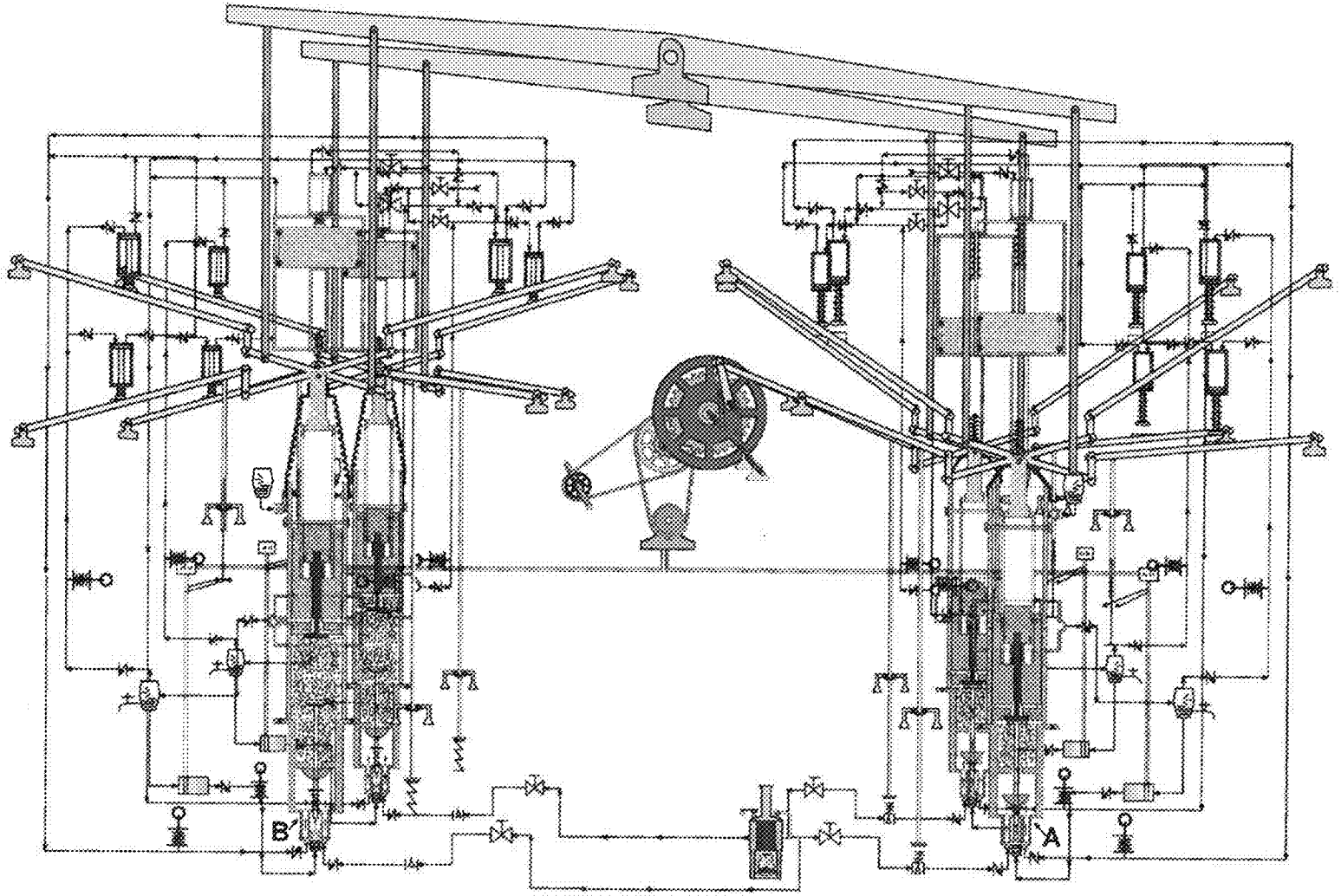
FIG. 9 illustrates an arrangement consisting of four piston steam powered reciprocating piston engine system in accordance with the present invention.

Finally, FIG. 9 illustrates an arrangement consisting of four piston steam powered reciprocating piston engine system in accordance with the present invention. As should be apparent, any suitable arrangement and/or number of pistons may be combined within the scope of the present invention. Work generated by the system may be used to power any power consuming or receiving apparatus or system, including vehicles, generators, or any other suitable device.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A reciprocating piston engine system comprising:

a pressurized working fluid source;

first and second generally vertically disposed reciprocating piston systems powered by a pressurized working fluid;

a lever arm having a first end connected to said first reciprocating piston system and an opposing second end connected to said second reciprocating piston system, said lever arm configured for pivotal movement about a pivot in response to reciprocation of said first and second piston systems;

each reciprocating piston system including;

(a) a cylinder having a top end portion, a bottom end portion including an inlet, and at least one exhaust port disposed between said top and bottom end portions;

(b) a piston received within said cylinder and capable of reciprocating movement, said piston performing a working stroke when moving from a bottom dead center (BDC) position to a top dead center (TDC) position;

(c) said cylinder inlet in fluid communication with said pressurized working fluid source;

(d) said cylinder inlet including a an actuating valve movable relative to said inlet between a closed position and an open position, said valve including an actuating stem configured for actuating said valve to the open configuration when said piston reaches the BDC position;

(e) said piston engaging said valve actuating stem upon returning to said BDC so as to actuate said valve to the open configuration whereby working fluid from said pressurized working fluid source flows through said valve into said cylinder to initiate a working stroke;

(f) said piston including a link arm projecting upward therefrom;

(g) a mass connected to said link arm by a spring connection, said mass confined to a track, said track restricting movement of said mass to movement in up and down vertical directions;

(h) a plurality of lever arms pivotally connected to said link arm and radially projecting therefrom in angularly spaced relation;

(i) said piston configured with an exhaust flow channel which comes into fluid communication with said at least one exhaust port to discharge at least a portion of said working fluid from said cylinder when said piston reaches said TDC position;

(j) a water accumulator having an inlet in fluid communication with said at least one exhaust port, said water accumulator including a vapor outlet and a water outlet;

(k) a booster pump actuated by at least one of said plurality of lever arms, said booster pump having an inlet in fluid communication with the vapor outlet of said water accumulator and an outlet in fluid communication with said cylinder inlet;

(l) an electric water pump having an inlet in fluid communication with said water accumulator outlet and an outlet in fluid communication with said cylinder inlet;

said system further including:

a flywheel with at least one of said lever arms mechanically connected thereto to drive said flywheel;

a mechanical power transmission apparatus having an input connected to said flywheel and first and second power transmission outputs;

an electrical generator connected to said first power transmission output, said electrical generator having an electrical power output in electrical communication with said electric water pump associated with each of said first and second piston systems, said water pump including an on/off switch, said on/off switch activating said water pump when said piston is at said BDC position; and said second power transmission output being available to provide power output from said system.

* * * * *